United States Patent [19]

Lisec

[11] 4,406,726

[45] Sep. 27, 1983

[54] APPARATUS FOR PRODUCING COMPACTED INSULATING GLASS HAVING PARALLEL PLANAR FACES

[76] Inventor: Peter Lisec, Bahnhofstrasse 34 (Niederosterreich), Amstetten-Hausmening, Austria

[21] Appl. No.: 309,119

[22] Filed: Oct. 6, 1981

[30] Foreign Application Priority Data

May 11, 1981 [AT] Austria ..... 2080/81

[51] Int. Cl.[3] ..... B30B 1/08; B30B 1/24; B30B 15/06

[52] U.S. Cl. ..... 156/360; 100/257; 100/258 A; 100/271; 100/288; 156/378; 156/497; 156/580

[58] Field of Search ..... 156/99, 109, 497, 580, 156/583.1, 360, 378; 100/93 P, 257, 258 A, 270, 271, 288

[56] References Cited

U.S. PATENT DOCUMENTS

| | | | |
|---|---|---|---|
| 443,995 | 1/1891 | Hiser | 100/288 |
| 1,267,492 | 5/1918 | Young | 100/288 |
| 1,880,873 | 10/1932 | Derry | 100/257 |
| 2,353,388 | 7/1944 | Cannon | 100/258 A |
| 3,562,474 | 2/1971 | Sellmann et al. | 100/288 |
| 3,920,504 | 11/1975 | Shoh et al. | 156/580 |
| 3,996,849 | 12/1976 | Del Jiacco | 100/258 A |
| 4,248,656 | 2/1981 | Hofmann | 156/497 |
| 4,369,084 | 1/1983 | Lisec | 156/109 |

*Primary Examiner*—Michael G. Wityshyn
*Attorney, Agent, or Firm*—Young & Thompson

[57] ABSTRACT

The apparatus for producing compacted insulating glass comprises two substantially vertical press platens, one of which is adapted to be moved relative to the stationary press platen in a frame in order to perform the compacting operation. Racks extending at right angles to the movable press platen are rigidly connected to the latter and in mesh with pinions rotatably mounted on fixed axes in the frame. A common drive is provided to rotate the pinions in synchronism. The stationary press platen may carry backing rollers, which can be retracted into the stationary press platen.

21 Claims, 2 Drawing Figures

APPARATUS FOR PRODUCING COMPACTED INSULATING GLASS HAVING PARALLEL PLANAR FACES

Figure 1:
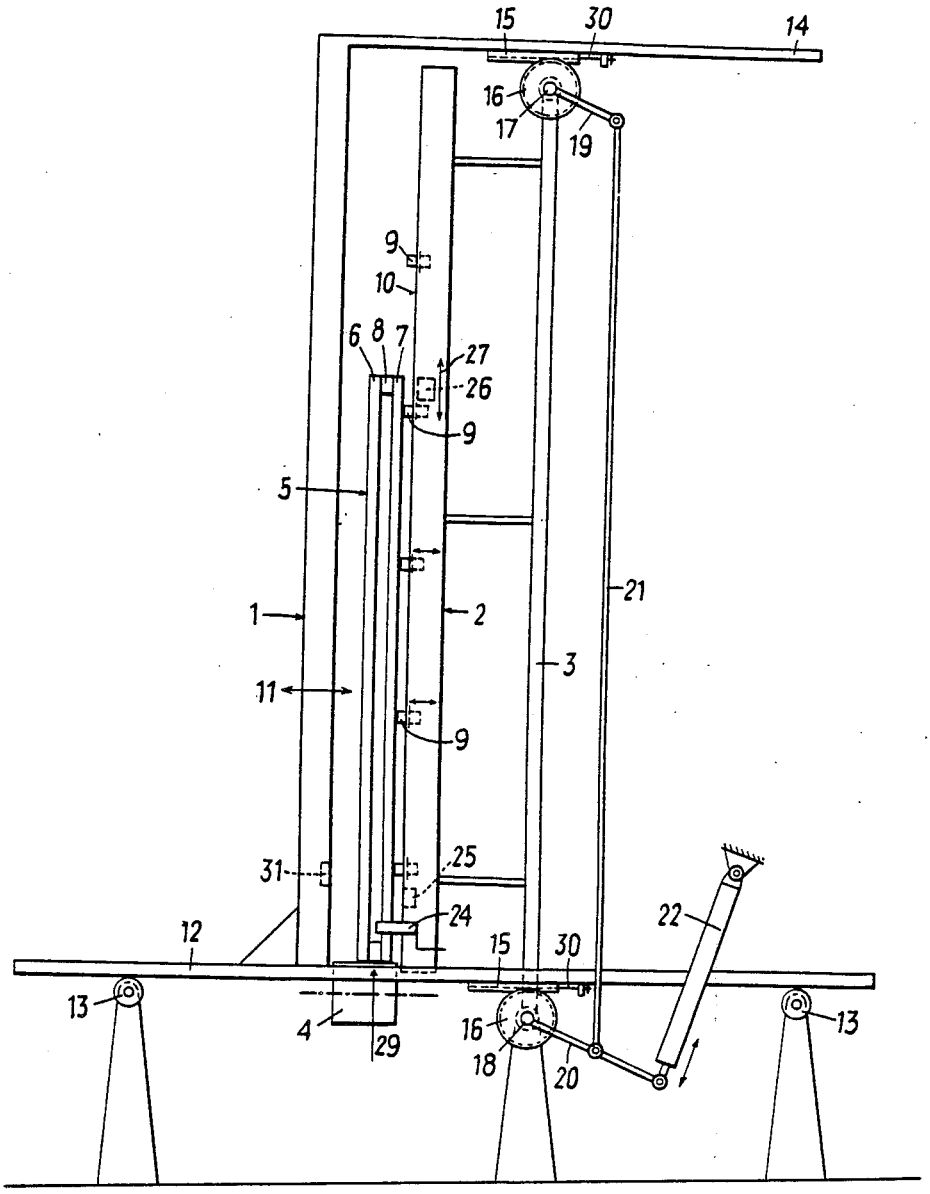

This invention comprises apparatus for producing compacted insulating glass having parallel planar faces, comprising two substantially vertical press platens, one of which is stationary whereas the other press platen is mounted in a frame and movable relative to the stationary press platen to perform the compacting operation, and a conveyor, which is disposed adjacent to the lower longitudinal edge of the stationary press platen and serves to compact the insulating glass.

In known apparatus of that kind, the movable press platen is forced by a plurality of fluid-operable cylinders against the insulating glass, which lies against the stationary press platen. It has been found that it is extremely difficult or even impossible to supply pressure fluid to a plurality of fluid-operable cylinders so that the latter are operated absolutely in unison. But when the fluid-operable cylinders do not uniformly move the movable press platen, the insulating glass panels will not be properly compacted or the glass panes will even break, in case of particularly large deviations.

It is an object of the invention to provide apparatus of the kind descibed first hereinbefore wherein the movement of the movable press platen can be more accurately controlled and the movable press platen can be moved toward the stationary press platen without being canted so that it always remains parallel to the stationary press platen.

This is accomplished according to the invention in that the movable press platen is rigidly connected to racks, which extend at right angles to the movable press platen and are in mesh with pinions that are rotatable on axes that are fixed in the frame, and common drive means are provided for rotating said pinions in synchronism.

In such an arrangement, the pinions in mesh with the racks can be rotated only in synchronism so that a displacement of the movable press platen without canting is ensured.

Another problem arising in connection with the known surface presses is due to the fact that the insulating glass panel is spaced from the stationary press platen by a cushion of air as it is moved to its end position in engagement with the stationary press platen. That air cushion must be adjusted in dependence on the size and weight of the glass panes; this adjustment is very difficult. If air under an excessively high pressure is supplied to the air cushion, the insulating glass panel may be moved too far away from the stationary press platen. If an inadequate quantity of air or air under an inadequate pressure is supplied, then the insulating glasses will bear on the stationary press platen and cannot be moved to the desired end position.

Within the scope of the invention, that disadvantage of the known presses is eliminated in accordance with the invention in that the stationary press platen is slightly inclined from the vertical away from the movable press platen and carries backing rollers, which are adapted to be retracted entirely into the stationary press platen. The backing rollers carried by the stationary press platen are entirely retracted into said platen as soon as the insulating glass element has reached its predetermined end position.

Insulating glass panels which are received by the compacting station may be open at the bottom so that the bottom edge of the glass pane facing the movable press platen is not yet in contact with the associated leg of the spacing frame. Depending on the size of that glass pane, the same will sag more or less so that the glass panes of the compacted insulating glass panel will be curved inwardly, i.e., concave on the outside. This disadvantage is eliminated according to the invention in that the conveyor comprises horizontally spaced apart conveyor rollers and a plurality of upwardly directed nozzles are provided between adjacent ones of said conveyor rollers and serve to blow a gas into the space between the press platens. The blowing of air into the open-bottomed insulating glass panel eliminates the sag of the glass pane which faces the movable press platen so that the compacted insulating glass panels will be entirely planar.

Figure 2:
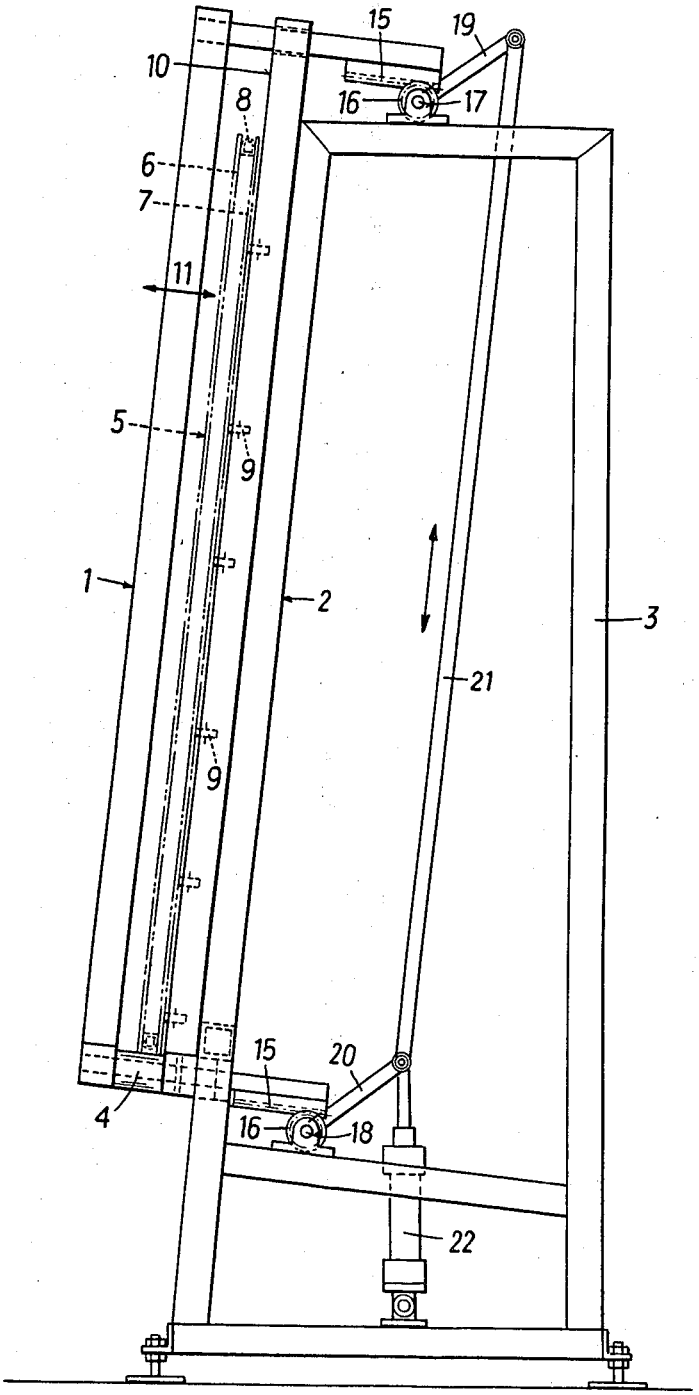

Further details and features of the invention will become apparent from the subsequent description with reference to the accompanying drawings, wherein FIGS. 1 and 2 are side elevations showing respective embodiments diagrammatically and by way of example.

The apparatus shown in FIG. 1 for producing compacted insulating glass panels having parallel planar faces comprises a movable press platen 1 and a stationary press platen 2, which is carried by a frame 3. The press platens 1 and 2 are parallel to each other and are inclined from the vertical by a few degrees, e.g., 5 degrees, toward the frame 3.

A conveyor is provided below the press platens 1 and 2 and in the embodiment shown in FIG. 1 consists of a plurality of horizontally spaced apart conveyor rollers 4, which are rotatably mounted on substantially horizontal axes. Drive means, not shown, serve to drive the conveyor rollers 4 so that they can convey insulating glass that is to be or has been compacted.

As is shown in FIG. 1, the insulating glass panel 5 comprises two glass panes 6 and 7 and an interposed spacing frame 8 and when it has been conveyed into the space between the press platens 1 and 2 bears on backing rollers 9. These backing rollers 9 are mounted in the press platen 2 for rotation on substantially vertical axes and protrude slightly, e.g., by 1 to 2 mm, beyond that surface of the press platen 2 which faces the movable press platen 1. The backing rollers 9 can be entirely retracted into the press platen 2 and for this purpose can be moved by fluid-operable cylinders or other means, not shown, to a position behind the plane of the compacting surface 10 of the press platen 2. If the backing rollers 9 are retractable, drive means for retracting a plurality or all of the backing rollers in unison are preferably provided.

The press platen 1 which is movable in the direction of the double-headed arrow 11 is provided at its bottom edge with rails 12, which rest on rollers 13 to permit of a displacement of the press platen 1. Racks 15 are connected to the rails 12 and to brackets 14, which extend from the top end of the press platen 1 and are parallel to the rails 12. The racks 15 are in mesh with pinions 16. Whereas only one rack 15 is shown in FIG. 1 at the top and bottom ends of the press platen 1, it is recommendable to provide two racks 15 and rails 12 and brackets 14 associated therewith at each of the top and bottom ends of the press platen 1.

The pinions 16 are non-rotatably secured to shafts 17 and 18, which are rotatably mounted in the frame 3. The shafts 17 and 18 are coupled for synchronous rotation by means of levers 19 and 20 and a coupling rod 21. Drive means, e.g., a pressure-fluid cylinder 22, are connected to an extension of the lever 20 and serve to operate the pinions 16.

By means of that arrangement comprising racks and pinions, the fluid-operable cylinder can displace the press platen 1 in the direction of the double-headed arrow 11 without any canting.

A retractable limit stop 24 is provided at the delivery end of the stationary press platen 2. A sensor 25 consisting, e.g., of a proximity switch, is mounted in the press platen 2 and is disposed before and spaced from the limit stop 24 and in response to the detection of the insulating glass panel acts to decrease the velocity at which the conveyor rollers 4 convey the insulating glass panel. As a result, the latter will not strike on the limit stop 24 at full speed.

A measuring device 26 is associated with the stationary plate 2 and is movable up and down in the direction of the double-headed arrow 27. The measuring device 26 serves to measure the height of the insulating glass panel 5 and in dependence thereon to control the pressure of the air which is supplied to upwardly directed air discharge nozzles disposed between adjacent conveyor rollers 4 and symbolized in the drawing by an arrow 29. The arrangement is such that the air is supplied to the nozzles 29 under a higher pressure when larger, i.e., higher glass panels have been detected by the measuring device 26.

To permit an adjustment of the movable press platen 1 to a position in which it is perfectly parallel to the stationary press platen 2, the racks 15 are adjustable by adjusting means 30 relative to the rails 12 and the brackets 14, respectively. The adjusting means may comprise screws connected to the racks and nuts screwable on said screws.

The apparatus described thus far operates as follows:

An insulating glass panel 5 consisting of the two glass panes 6 and 7 and the interposed spacing frame 8 is placed on edge on the conveyor rollers 4 and moved as far as to the limit stop 24 while it lies against the backing rollers 9 in the press platen 2. Before the insulating glass panel 5 engages the limit stop 24, the switch 25 operates to decrease the speed of travel and to brake the insulating glass panel 5. As soon as the insulating glass panel 5 has reached its end position, the backing rollers 9, if they are retractable, are retracted into the press platen 2, so that the glass pane 6 lies against the surface 10 of the press platen 2; that surface is covered, e.g., with felt. After a period of time controlled by a timer, pressure fluid is then supplied to the fluid-operable cylinder 22 so that the pinions 16 are rotated and the movable press platen 1 is moved toward the stationary press platen 2 and the insulating glass panel 5 lying against the same.

If the insulating glass panel 5 is still open at its bottom, i.e., has a gap between each glass pane and the spacing frame, air is supplied to the upwardly directed nozzles disposed between the conveyor rollers 4. The pressure of said air depends on the position of the measuring device 26 corresponding to the level of the top edge of the insulating glass panel 5. As soon as the movable press platen 1 contacts the glass pane 7, a sensor 31 causes the supply of air to the nozzles 29 to be interrupted whereafter the compacting operation is completed within 1 to 2 seconds. That time will be sufficient for a relief of any overpressure from the interior of the insulating glass panel 5 before the bottom gap is closed.

When the compacting operation has been terminated, pressure fluid is supplied to the fluid-operable cylinder 22 to move the movable press platen 1 away from the stationary press platen 2, the limit stop 24 is retracted from its operative position and the compacted insulating glass panel 5 is removed from the apparatus on the conveyor rollers 4.

In addition to ensuring that the two press platens are absolutely parallel in every phase of the compacting operation, the apparatus according to the invention affords the advantage that the required pressure force to be applied, amounting to a total of 5 tons, can be exerted by small fluid-operable cylinders about 50 mm in diameter owing to the mechanical advantage.

Besides, in the apparatus according to the invention the movable press platen can readily be shifted over a large distance from the stationary press platen when the rack-and-pinion drives have been disengaged, e.g., for cleaning and maintenance work. To eliminate the need for time-consuming adjusting work when the rack-and-pinion drives are to be re-engaged, stops may be provided, which will ensure that the racks and pinions will interengage in preset positions.

Another embodiment of the apparatus according to the invention is shown in FIG. 2 and comprises a movable press platen 1 which is carried by the frame 3 just as the stationary press platen 2. For the sake of clearness, the limit stop 24 and the measuring device 26 are not shown in FIG. 2.

What is claimed is:

1. In apparatus for producing compacted insulating glass panels having parallel planar faces, comprising a stationary frame, two substantially vertical press platens, one of which is stationary and has a bottom longitudinal edge, and the other of which is mounted in said frame and movable relative to the stationary press platen to perform a compacting operation, and a conveyor disposed adjacent to and extending along said longitudinal edge and operable to convey insulating glass between said press platens, the improvement residing in that racks extending at right angles to said movable press platen are rigidly connected to said movable press platen, pinions in mesh with said racks are rotatably mounted on stationary axles secured to said frames, common drive means are connected to said pinions to rotate them about said axles, said pinions are interconnected by coupling means constraining said pinions to rotate in unison, said movable press platen has top and bottom edges, shafts are rotatably mounted on stationary axes in said frame and operatively connected to said common drive means, said pinions are non-rotatably connected to said shafts, said coupling means comprise levers, which are non-rotatably connected to respective ones of said shafts, and a rod connecting said levers, and said common drive means are connected to one of said levers.

2. The improvement set forth in claim 1, wherein said racks are adjustable relative to said movable press platen.

3. The improvement set forth in claim 1, wherein said common drive means comprise a fluid-operable cylinder.

4. The improvement set forth in claim 3, wherein
rods extending at right angles to said movable press platen are rigidly connected to said movable press platen, and
said racks are adjustably mounted on said rods.

5. The improvement set forth in claim 1, wherein
said stationary press platen is slightly inclined from the vertical away from said movable press platen and
backing rollers are carried by said stationary press platen on the side facing said movable press platen and are retractable entirely into said stationary press platen.

6. The improvement set forth in claim 5, wherein roller-driving means are operatively connected to said backing rollers and operable to retract said backing rollers entirely into said stationary press platen.

7. The improvement set forth in claim 6, wherein said roller-driving means consist of fluid-operable cylinders.

8. The improvement set forth in claim 6, wherein a common roller-driving means is operatively connected to a plurality of said backing rollers.

9. The improvement set forth in claim 1, wherein
said conveyor comprises a plurality of horizontally spaced apart conveyor rollers and
a plurality of upwardly directed nozzles for blowing a gas into the space between said press platens are arranged between adjacent ones of said conveyor rollers.

10. The improvement set forth in claim 9, wherein a sensor is associated with said nozzles and arranged to interrupt the supply of gas to said nozzles as soon as the movable press platen contacts an insulating glass panel disposed between said press platens.

11. The improvement set forth in claim 9, wherein
control means are provided for varying the pressure of said gas supplied to said nozzles in dependence on the size of an insulating glass panel disposed between said press platens so that the pressure is relatively high in case of a relatively large insulating glass panel and
said control means comprise a measuring device for measuring the size of said insulating glass panel.

12. The improvement set forth in claim 11, wherein said measuring device is adapted to measure the height of said insulating glass panel.

13. In apparatus for producing compacted insulating glass panels having parallel planar faces, comprising
a stationary frame,
two substantially vertical press platens, one of which is stationary and has a bottom longitudinal edge, and the other of which is mounted in said frame and movable relative to the stationary press platen to perform a compacting operation, and
a conveyor disposed adjacent to and extending along said longitudinal edge and operable to convey insulating glass between said press platens,
the improvement residing in that
said stationary press platen is slightly inclined from the vertical away from said movable press platen and
backing rollers are carried by said stationary press platen on the side facing said movable press platen and are retractable entirely into said stationary press platen.

14. The improvement set forth in claim 13, wherein roller-driving means are operatively connected to said backing rollers and operable to retract said backing rollers entirely into said stationary press platen.

15. The improvement set forth in claim 14, wherein said roller drive means consists of fluid-operable cylinders.

16. The improvement set forth in claim 14, wherein a common drive means is operatively connected to a plurality of said backing rollers.

17. In apparatus for producing compacted insulating glass panels having parallel planar faces, comprising
a stationary frame,
two substantially vertical press platens, one of which is stationary and has a bottom longitudinal edge, and the other of which is mounted in said frame and movable relative to the stationary press platen to perform a compacting operation, and
a conveyor disposed adjacent to and extending along said longitudinal edge and operable to convey insulating glass between said press platens,
the improvement residing in that
said conveyor comprises a plurality of horizontally spaced apart conveyor rollers and
a plurality of upwardly directed nozzles for blowing a gas into the space between said press platens are arranged between adjacent ones of said conveyor rollers.

18. The improvement set forth in claim 17, wherein a sensor is associated with said nozzles and arranged to interrupt the supply of gas to said nozzles as soon as the movable press platen contacts an insulating glass panel disposed between said press platens.

19. The improvement set forth in claim 17, wherein
control means are provided for varying the pressure of said gas supplied to said nozzles in dependence on the size of an insulating glass panel disposed between said press platens so that the pressure is relatively high in case of a relatively large insulating glass panel and
said control means comprise a measuring device for measuring the size of said insulating glass panel.

20. The improvement set forth in claim 19, wherein said measuring device is adapted to measure the height of said insulating glass panel.

21. In apparatus for producing compacted insulating glass panels having parallel planar faces, comprising
a stationary frame,
two substantially vertical press platens, one of which is stationary and has a bottom longitudinal edge, and the other of which is mounted in said frame and movable relative to the stationary press platen to perform a compacting operation, and
a conveyor disposed adjacent to and extending along said longitudinal edge and operable to convey insulating glass between said press platens,
the improvement residing in that
racks extending at right angles to said movable press platen are rigidly connected to said movable press platen,
pinions in mesh with said racks are rotatably mounted on stationary axles secured to said frames,
common drive means are connected to said pinions to rotate them about said axles,
said pinions are interconnected by coupling means constraining said pinions to rotate in unison,
said stationary press platen is slightly inclined from the vertical away from said movable press platen,
backing rollers are carried by said stationary press platen on the side facing said movable press platen and are retractable entirely into said stationary press platen and said conveyor comprises a plurality of horizontally spaced apart conveyor rollers and a plurality of upwardly directed nozzles for blowing a gas into the space between said press platens are arranged between adjacent ones of said conveyor rollers.

* * * * *